US007665149B2

(12) United States Patent
Carbajal et al.

(10) Patent No.: US 7,665,149 B2
(45) Date of Patent: Feb. 23, 2010

(54) BALLISTIC RESISTANT BODY ARMOR ARTICLES

(75) Inventors: Leopoldo Alejandro Carbajal, Newark, DE (US); Ronald G. Egres, Jr., Midlothian, VA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 142 days.

(21) Appl. No.: 12/152,404

(22) Filed: May 14, 2008

(65) Prior Publication Data

US 2009/0282596 A1 Nov. 19, 2009

(51) Int. Cl.

| | |
|---|---|
| ***F41H 1/02*** | (2006.01) |
| ***F41H 5/04*** | (2006.01) |
| ***B32B 5/12*** | (2006.01) |
| *F41H 1/00* | (2006.01) |

(52) U.S. Cl. ..... 2/2.5; 89/36.05; 89/36.02; 428/105

(58) Field of Classification Search ..... 2/2.5; 89/36.05, 36.02; 428/105, 113, 297.4, 911
See application file for complete search history.

(56) References Cited

U.S. PATENT DOCUMENTS

| | | | | |
|---|---|---|---|---|
| 2,919,217 | A * | 12/1959 | Bobkowicz | 428/108 |
| 3,018,091 | A | 1/1962 | Duggins | |
| 3,094,511 | A | 6/1963 | Hill, Jr. et al. | |
| 3,354,127 | A | 11/1967 | Hill, Jr. et al. | |
| 3,641,638 | A * | 2/1972 | Laible | 28/112 |
| 3,673,143 | A | 6/1972 | Bair et al. | |
| 3,769,142 | A * | 10/1973 | Holmes et al. | 428/113 |
| 3,819,587 | A | 6/1974 | Kwoleck | |
| 3,869,429 | A | 3/1975 | Blades | |
| 3,869,430 | A | 3/1975 | Blades | |
| 4,161,559 | A * | 7/1979 | Bosse | 428/110 |
| 4,172,938 | A | 10/1979 | Mera et al. | |
| 4,181,768 | A | 1/1980 | Severin | |
| 4,228,118 | A | 10/1980 | Wu et al. | |
| 4,276,348 | A | 6/1981 | Wu et al. | |

(Continued)

FOREIGN PATENT DOCUMENTS

WO WO 2007/058679 A2 5/2007

(Continued)

OTHER PUBLICATIONS

W. B. Black and J. Preston, Fiber-Forming Aromatic Polyamides, Man-Made Fibers—Science and Technologies, vol. 2, Interscience Publishers, 1968, p. 297.

*Primary Examiner*—Bobby H Muromoto, Jr.

(57) ABSTRACT

The present invention relates to body armor articles for resisting ballistic objects. The articles comprise woven fabric layers and sheet layers. The woven fabric layers are made from yarns having a tenacity of at least 7.3 grams per dtex and a modulus of at least 100 grams per dtex. The sheet layers comprise nonwoven random oriented fibrous sheets, each of the sheet layers comprising a uniform mixture of 3 to 60 weight percent polymeric binder and 40 to 97 weight percent non-fibrillated fibers. The woven fabric layers and the sheet layers are stacked together comprising a first core section which includes at least two repeating units of, in order, at least one of the woven fabric layers then at least one of the sheet layers. The sheet layers comprise 0.5 to 30 wt % of the total weight of the article.

23 Claims, 6 Drawing Sheets

U.S. PATENT DOCUMENTS 4,344,908 A 8/1982 Smith et al.
4,457,985 A 7/1984 Harpell et al.
4,478,083 A 10/1984 Hassler et al.
4,533,693 A 8/1985 Wolfe et al.
4,623,574 A * 11/1986 Harpell et al. ..... 428/113
4,650,710 A * 3/1987 Harpell et al. ..... 442/135
4,698,267 A 10/1987 Tokarsky
4,703,103 A 10/1987 Wolfe et al.
4,737,401 A * 4/1988 Harpell et al. ..... 442/187
4,748,064 A * 5/1988 Harpell et al. ..... 428/113
4,772,678 A 9/1988 Sybert et al.
4,847,350 A 7/1989 Harris
4,879,165 A * 11/1989 Smith ..... 428/212
4,963,298 A * 10/1990 Allen et al. ..... 264/12
5,026,456 A 6/1991 Hesler et al.
5,089,591 A 2/1992 Gregory et al.
5,160,776 A 11/1992 Li et al.
5,175,040 A * 12/1992 Harpell et al. ..... 428/113
5,179,244 A * 1/1993 Zufle ..... 89/36.02
5,223,094 A 6/1993 Kirayoglu et al.
5,276,128 A 1/1994 Rosenberg et al.
5,314,742 A 5/1994 Kirayoglu et al.
5,343,796 A * 9/1994 Cordova et al. ..... 89/36.02
5,362,527 A * 11/1994 Harpell et al. ..... 428/33
5,376,426 A * 12/1994 Harpell et al. ..... 428/109
5,440,965 A * 8/1995 Cordova et al. ..... 89/36.02
5,474,842 A 12/1995 Hoiness
5,480,706 A * 1/1996 Li et al. ..... 428/113
5,736,474 A * 4/1998 Thomas ..... 442/388
5,935,678 A 8/1999 Park
5,960,470 A * 10/1999 Bachner, Jr. ..... 2/2.5
6,003,424 A * 12/1999 Cordova et al. ..... 89/36.02
6,030,683 A 2/2000 Chitrangad
6,103,641 A * 8/2000 Gehring, Jr. ..... 442/46
6,248,676 B1 * 6/2001 Dischler ..... 442/101
6,276,254 B1 * 8/2001 Cordova et al. ..... 89/36.02
6,323,145 B1 * 11/2001 Popper et al. ..... 442/366
6,503,856 B1 * 1/2003 Broadway et al. ..... 442/366
6,846,545 B2 * 1/2005 Thomas ..... 428/85
6,846,548 B2 * 1/2005 Harpell et al. ..... 428/198
6,846,758 B2 1/2005 Bhatnagar et al.
6,949,280 B2 9/2005 Brillhart, III et al.
7,101,818 B2 * 9/2006 Price et al. ..... 442/268
7,148,162 B2 * 12/2006 Park et al. ..... 442/134
2003/0139108 A1 7/2003 Klintworth et al.
2004/0132368 A1 * 7/2004 Price et al. ..... 442/247
2007/0003334 A1 1/2007 Shinshi et al.
2007/1011748 5/2007 Bhatnagar et al.
2009/0004413 A1 * 1/2009 Wagner et al. ..... 428/34.1
2009/0188014 A1 * 7/2009 Chiou ..... 2/2.5

FOREIGN PATENT DOCUMENTS

WO WO 2007/067949 A2 6/2007

* cited by examiner

BALLISTIC RESISTANT BODY ARMOR ARTICLES

BACKGROUND OF THE INVENTION

1. Field of the Invention

This invention relates to ballistic resistant body armor.

2. Description of Related Art

Many designs for body armor for resisting ballistic threats have been proposed and many commercialized. Designs are made to increase comfort by the wearer to increase their use. Comfort is generally increased by making them lighter and more flexible to allow freedom of motion by the wearer. However, apparel weight needs to be increased to provide protection against projectiles with greater velocities and mass. It is also desirable to minimize the costs to make the apparel, but traditional materials used in body armor are relatively expensive.

Standards have been proposed and adopted throughout the world to ensure minimum capabilities of body armor for resisting ballistic objects. See NIJ Standard—0101.04 "Ballistic Resistance of Personal Body Armor", issued in September 2000. It defines capabilities for body armor for level IIA, II, IIIA and III protection. To achieve level 11 protection, the armor must have no penetration and no more than a backface deformation of 44 mm by a projectile such as a 0.357 magnum projectile at a velocity ($V_o$) defined as 1430 ft/sec plus or minus (+/−) 30 feet per sec (436 m/sec +/−9 m/sec). To achieve level IIIA protection, the armor must have no penetration and no more than a backface deformation of 44 mm by a 0.44 magnum or similar projectile at a velocity ($V_o$) defined as 1430 ft/sec plus or minus (+/−) 30 feet per sec (436 m/sec +/−9 m/sec). Body armor is frequently designed with a margin of safety surpassing the requirements of the Standard. However, increasing the margin of safety typically increases the cost and weight and decreases the flexibility of the body armor. So body armor is typically made to meet published standards with a small margin of safety.

There are also many designs for body armor for resisting spike (e.g., ice pick like) or knife stabbing or slashing threats. However, such designs typically are not optimum or even necessarily able to protect against ballistic threats. Separate standards have been published providing different tests and requirements for such spike or knife resistant body armor compared to standards for ballistic resistant body armor. Thus, those skilled in the art do not assume teachings on making or optimizing spike or knife resistant body armor are useful in designing ballistic resistant body armor.

Body armor meeting the NIJ ballistic standard level 11 or IIIA protection can be made solely of woven fabric layers made from high tenacity multifilament yarns, such as made from para-aramid. Such woven fabric layers provide very good penetration resistance against bullets and fragments. However, woven fabric layers alone provide less protection against backface deformation requiring more layers and increased weight to meet the margin of safety or even the standard. Hybrid body armor meeting the level II or IIIA protection can be made using a plurality of such woven fabric layers stacked in combination with a plurality of unidirectional assemblies comprising a unidirectional tape made of an array of parallel high tenacity multifilament yarns in a matrix resin stacked with adjacent tapes with their yarns at angles inclined with respect to adjacent tapes. Typically the yarns in the tapes are at right angles with respect to yarns in adjacent tapes. These hybrid body armors provide good penetration resistance against bullets, greater protection against backface deformation, but replacing woven fabric layers with unidirectional assemblies reduces protection against fragments, increases rigidity and increases cost. Body armor meeting the level II or IIIA protection can be made solely using a plurality of the unidirectional assemblies. They provide good penetration resistance against bullets, very good protection against backface deformation, but they typically provide the least protection against fragments, are more rigid than the other options, and are the most expensive.

U.S. Pat. No. 6,030,683 to Chitrangad describes the positioning of a pulp layer between woven fabric layers to provide increased wearer comfort and flexibility. The pulp is made by refining short length fibers (floc) to fibrillate them thus yielding splayed ends and hair-like fibrils extending from the fiber trunk. The pulp is compressed into a paper having a thickness of between 0.5 to 5 millimeters. Assemblies comprising woven fabric layers and pulp sheets were evaluated against 22 caliber fragment simulating projectiles. Results showed up to 5% deterioration in ballistic resistance when compared with an equivalent weight assembly comprising only woven fabric. While considered acceptable for protection against fragments, such a pulp sheet assembly does not provide protection against deformable projectiles such as a 0.44 magnum bullets that have higher impact energies.

It is an object of this invention to provide improved body armor designs that utilize the advantages of woven fabric layers described above without incorporating unidirectional assemblies and their associated disadvantages.

These and other objects of the invention will be clear from the following description.

BRIEF SUMMARY OF THE INVENTION

The invention relates to body armor articles for resisting ballistic objects, comprising:

a plurality of woven fabric layers woven from yarns having a tenacity of at least 7.3 grams per dtex and a modulus of at least 100 grams per dtex;

a plurality of sheet layers comprising nonwoven random oriented fibrous sheets, each of the sheet layers comprising a uniform mixture of 3 to 60 weight percent polymeric binder and 40 to 97 weight percent non-fibrillated fibers, the non-fibrillated fibers having a yarn tenacity of at least 1.8 grams per dtex and a modulus of at least 75 grams per dtex, and wherein each of the sheet layers has a thickness of at least 0.013 mm (0.5 mils);

the woven fabric layers and the sheet layers stacked together comprising a first core section which includes at least two repeating units of, in order, at least one of the woven fabric layers then at least one of the sheet layers; and the sheet layers comprising 0.5 to 30 wt % of the total weight of the article.

BRIEF DESCRIPTION OF THE DRAWING(S)

The invention can be more fully understood from the following detailed description thereof in connection with accompanying drawings described as follows.

DETAILED DESCRIPTION OF THE INVENTION

Figure 1:
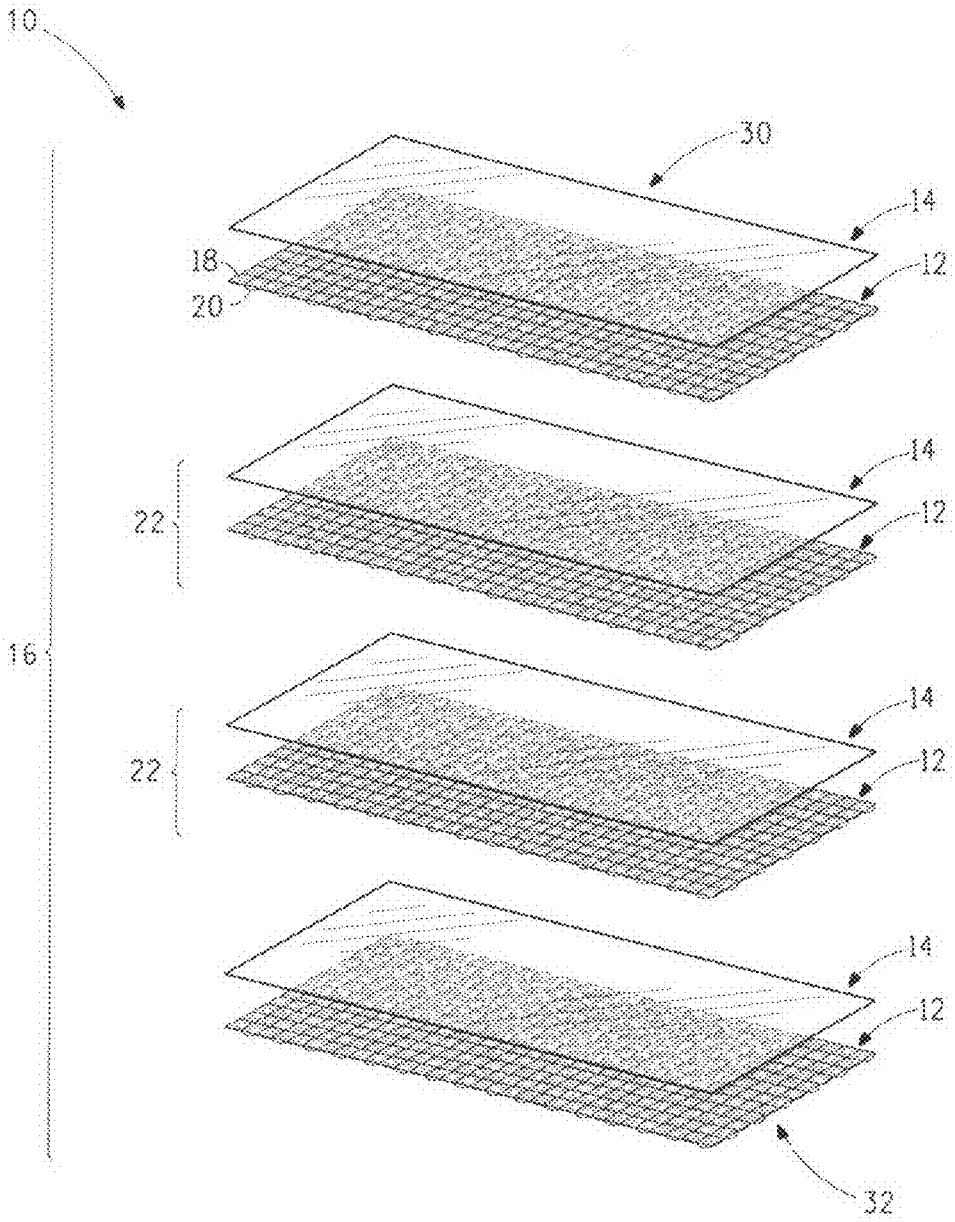
FIG. 1 is an exploded perspective view of a first embodiment of a ballistic penetration resistant article with a woven fabric layer on one end and a nonwoven sheet layer on the other end in accordance with the present invention.

The present invention may be understood more readily by reference to the following detailed description of illustrative and preferred embodiments that form a part of this disclosure. It is to be understood that the scope of the claims is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. When a range of values is expressed, another embodiment includes from the one particular value and/or to the other particular value. Similarly, when values are expressed as approximations, by use of the antecedent "about," it will be understood that the particular value forms another embodiment. All descriptions, limitations and ranges are inclusive and combinable. Further, throughout the following detailed description, similar reference characters refer to similar elements in all figures of the drawings.

Referring to FIG. 1 which shows an exploded perspective view of one embodiment of the present invention, the invention is directed to a body armor article 10 for resisting ballistic objects. The body armor article 10 is for incorporation into body armor and comprises a plurality of woven fabric layers 12 and a plurality of nonwoven sheet layers 14 stacked together to comprise a first core section 16. The first core section 16 includes at least two repeating units 22 of, in order, at least one of the woven fabric layers 12 then at least one of the nonwoven sheet layers 14. The nonwoven sheet layers 14 comprise 0.5 to 30 wt % of the total weight of the article.

The Woven Fabric Layers

The fabric layers 12 are woven. The term "woven" is meant herein to be any fabric that can be made by weaving; that is, by interlacing or interweaving at least two yarns 18, 20 typically at right angles. Generally such fabrics are made by interlacing one set of yarns 18, called warp yarns, with another set of yarns 20, called weft or fill yarns. The woven fabric can have essentially any weave, such as, plain weave, crowfoot weave, basket weave, satin weave, twill weave, unbalanced weaves, and the like. Plain weave is the most common and is preferred.

In some embodiments, each woven fabric layer 12 has a basis weight of from 50 to 800 g/m$^2$. In some preferred embodiments the basis weight of each woven layer is from 100 to 600 g/m$^2$. In some most preferred embodiments the basis weight of a woven layer is from 130 to 500 g/m$^2$.

In some embodiments, the fabric yarn count is 5 to 100 ends per inch (2 to 39 ends per centimeter) in the warp, preferably 8 to 60 ends/inch (3 to 24 ends per centimeter). In some most preferred embodiments the yarn count is 10 to 45 ends/inch (4 to 18 ends per centimeter) in the warp. In some embodiments, the fabric yarn count in the weft or fill is 5 to 100 ends per inch (2 to 39 ends per centimeter), preferably 8 to 60 ends/inch (3 to 24 ends per centimeter). In some most preferred embodiments the yarn count in the weft or fill is 10 to 45 ends/inch (4 to 18 ends per centimeter).

The woven fabric layers 12 are preferably not encased or coated with a matrix resin. In other words, they are matrix resin free. By "matrix resin" is meant an essentially homogeneous resin or polymer material in which the yarn is embedded.

Yarns and Filaments

The fabric layers 12 are woven from multifilament yarns having a plurality of filaments. The yarns can be intertwined and/or twisted. For purposes herein, the term "filament" is defined as a relatively flexible, macroscopically homogeneous body having a high ratio of length to width across its cross-sectional area perpendicular to its length. The filament cross section can be any shape, but is typically circular or bean shaped. Herein, the term "fiber" is used interchangeably with the term "filament", and the term "end" is used interchangeably with the term "yarn".

The filaments can be any length. Preferably the filaments are continuous. Multifilament yarn spun onto a bobbin in a package contains a plurality of continuous filaments. The multifilament yarn can be cut into staple fibers and made into a spun staple yarn suitable for use in the present invention. The staple fiber can have a length of about 1.5 to about 5 inches (about 3.8 cm to about 12.7 cm). The staple fiber can be straight (i.e., non crimped) or crimped to have a saw tooth shaped crimp along its length, with a crimp (or repeating bend) frequency of about 3.5 to about 18 crimps per inch (about 1.4 to about 7.1 crimps per cm).

The yarns have a yarn tenacity of at least 7.3 grams per dtex and a modulus of at least 100 grams per dtex. Preferably, the yarns have a linear density of 50 to 4500 dtex, a tenacity of 10 to 65 g/dtex, a modulus of 150 to 2700 g/dtex, and an elongation to break of 1 to 8 percent. More preferably, the yarns have a linear density of 100 to 3500 dtex, a tenacity of 15 to 50 g/dtex, a modulus of 200 to 2200 g/dtex, and an elongation to break of 1.5 to 5 percent.

Fabric Layer Fiber Polymer

The yarns of the present invention may be made with filaments made from any polymer that produces a high-strength fiber, including, for example, polyamides, polyolefins, polyazoles, and mixtures of these.

When the polymer is polyamide, aramid is preferred. The term "aramid" means a polyamide wherein at least 85% of the amide (—CONH—) linkages are attached directly to two aromatic rings. Suitable aramid fibers are described in Man-Made Fibres—Science and Technology, Volume 2, Section titled Fibre-Forming Aromatic Polyamides, page 297, W. Black et al., Interscience Publishers, 1968. Aramid fibers and their production are, also, disclosed in U.S. Pat. Nos. 3,767,756; 4,172,938; 3,869,429; 3,869,430; 3,819,587; 3,673,143; 3,354,127; and 3,094,511.

The preferred aramid is a para-aramid. The preferred para-aramid is poly(p-phenylene terephthalamide) which is called PPD-T. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride or 3,4'-diaminodiphenylether.

Additives can be used with the aramid and it has been found that up to as much as 10 percent or more, by weight, of other polymeric material can be blended with the aramid. Copolymers can be used having as much as 10 percent or more of other diamine substituted for the diamine of the aramid or as much as 10 percent or more of other diacid chloride substituted for the diacid chloride or the aramid.

When the polymer is polyolefin, polyethylene or polypropylene is preferred. The term "polyethylene" means a predominantly linear polyethylene material of preferably more than one million molecular weight that may contain minor amounts of chain branching or comonomers not exceeding 5 modifying units per 100 main chain carbon atoms, and that may also contain admixed therewith not more than about 50 weight percent of one or more polymeric additives such as alkene-1-polymers, in particular low density polyethylene, propylene, and the like, or low molecular weight additives such as anti-oxidants, lubricants, ultra-violet screening agents, colorants and the like which are commonly incorporated. Such is commonly known as extended chain polyethylene (ECPE) or ultra high molecular weight polyethylene (UHMWPE). Preparation of polyethylene fibers is discussed in U.S. Pat. Nos. 4,478,083, 4,228,118, 4,276,348 and Japanese Patents 60-047,922, 64-008,732. High molecular weight linear polyolefin fibers are commercially available. Preparation of polyolefin fibers is discussed in U.S. Pat No. 4,457,985.

In some preferred embodiments polyazoles are polyarenazoles such as polybenzazoles and polypyridazoles. Suitable polyazoles include homopolymers and, also, copolymers. Additives can be used with the polyazoles and up to as much as 10 percent, by weight, of other polymeric material can be blended with the polyazoles. Also copolymers can be used having as much as 10 percent or more of other monomer substituted for a monomer of the polyazoles. Suitable polyazole homopolymers and copolymers can be made by known procedures, such as those described in or derived from U.S. Pat. No. 4,533,693 (to Wolfe, et al., on Aug. 6, 1985), U.S. Pat. No. 4,703,103 (to Wolfe, et al., on Oct. 27, 1987), U.S. Pat. No. 5,089,591 (to Gregory, et al., on Feb. 18, 1992), U.S. Pat. No. 4,772,678 (Sybert, et al., on Sep. 20, 1988), U.S. Pat. No. 4,847,350 (to Harris, et al., on Aug. 11, 1992), and U.S. Pat. No. 5,276,128 (to Rosenberg, et al., on Jan. 4, 1994).

Preferred polybenzazoles are polybenzimidazoles, polybenzothiazoles, and polybenzoxazoles and more preferably such polymers that can form fibers having yarn tenacities of 30 gpd or greater. If the polybenzazole is a polybenzothioazole, preferably it is poly(p-phenylene benzobisthiazole). If the polybenzazole is a polybenzoxazole, preferably it is a it is poly(p-phenylene benzobisoxazole) and more preferably the poly(p-phenylene-2,6-benzobisoxazole) called PBO.

Preferred polypyridazoles are polypyrid imidazoles, polypyridothiazoles, and polypyridoxazoles and more preferably such polymers that can form fibers having yarn tenacities of 30 gpd or greater. In some embodiments, the preferred polypyridazole is a polypyridobisazole. The preferred poly(pyridobisozazole) is poly(1,4-(2,5-dihydroxy)phenylene-2,6-pyrido[2,3-d:5,6-d']bisimidazole which is called PIPD. Suitable polypyridazoles, including polypyridobisazoles, can be made by known procedures, such as those described in U.S. Pat. No. 5,674,969.

Sheet Layers

The sheet layers 14 comprise non-woven random oriented fibrous sheets. By "non-woven random oriented fibrous sheet" is meant a unitary network or arrangement of fibers wherein the fibers are not "woven" together; in some preferred embodiments the unitary network or arrangement of fibers is achieved by making a wet-laid structure like a paper. The nonwoven random oriented fibrous sheets are made of randomly oriented non-fibrillated fibers. The preferred form of nonwoven sheet comprises a uniform mixture of 40 to 97 weight percent non-fibrillated fiber and 3 to 60 weight percent of a polymeric binder, the fiber having a yarn tenacity of at least 1.8 grams per dtex, a modulus of at least 75 grams per dtex and an elongation at break of at least 2%. In some embodiments, the non-fibrillated fiber can have a yarn tenacity as high as 65 g/dtex, a modulus as high as 2700 g/dtex, and an elongation at break as high as 40 or even 50 percent. In some embodiments, the non-fibrillated fiber can be present in the nonwoven sheet in amount of 40 to 60 percent by weight and binder is present in an amount of 60 to 40 percent by weight. In some other embodiments, the non-fibrillated fiber can be present in the nonwoven sheet in an amount of 70 to 90 percent by weight and the binder is present in an amount of 10 to 30 percent by weight. In still other embodiments, the non-fibrillated fiber can be present in an amount of 88 to 97 percent by weight, and the binder is present in an amount of 3 to 12 percent by weight. The polymer of the fiber and binder may be the same or different. For example, a polymer having a substantially amorphous structure can be used as the binder while the same polymer, having a substantially crystalline structure, can be used for the non-fibrillated fiber The non-fibrillated fibers in the non-woven random oriented fibrous sheets can be in the form of continuous or cut fiber (floc). Floc is preferred. Floc comprises generally short fibers made by cutting continuous filaments into short lengths without refining to cause significant fibrillation; and the lengths of the floc or short fibers can be of almost any length, but typically the length varies from about 2 mm to 60 mm, more preferably from 2 mm to 20 mm. Short fibers suitable for use in the present invention include, for example, the reinforcing fibers disclosed in U.S. Pat. No. 5,474,842 to Hoiness. If the floc length is less than 2 millimeters, it is generally too short to provide nonwoven sheets or papers with adequate strength; if the floc length is more than 25 millimeters, it is very difficult to form uniform webs or papers, especially if they are made by a wet-laid process. Floc having a diameter of less than 5 micrometers, and especially less than 3 micrometers, is difficult to produce with adequate cross sectional uniformity and reproducibility; if the floc diameter is more than 20 micrometers, it is very difficult to form uniform nonwoven sheets or papers of light to medium basis weights. Floc can be made from a polymer selected from the group consisting of polyamides including aromatic polyamides, polysulfonamides, polyphenylene sulfide, polyolefins, polyazoles, acrylonitrile, polyimides and mixtures thereof. Aromatic polyamides are preferred polymers. Other suitable non-fibrillated fiber materials include glass, carbon and graphite fibers. The carbon and graphite fibers may be made from either polyacrylonitrile or pitch.

The preferred binder is a polymer fibrid. The term "fibrid" means non-granular, fibrous or film-like, particles. Fibrids are not fibers, but they are fibrous in that they have fiber-like regions connected by webs. In many instances fibrids have an average length of 0.1 to 1 mm in some embodiments have a width-to-length aspect ratio of about 5:1 to 10:1. The thickness dimension of the fibrid is 0.1 to 2 micrometers and typically on the order of a fraction of a micrometer. The fibrids can be prepared by any method including using a fibridating apparatus of the type disclosed in U.S. Pat. No. 3,018,091 where a polymer solution is precipitated and sheared in a single step. Fibrids are typically made by streaming a polymer solution into a coagulating bath of liquid that is immiscible with the solvent of the solution. The stream of polymer solution is subjected to strenuous shearing forces and turbulence as the polymer is coagulated.

In some embodiments, fibrids have have a melting point or decomposition point above 320° C. In some embodiments, the preferred polymers useful in making fibrids include polyamides including aromatic polyamides, polysulfonamides, poly-phenylene sulfide, polyolefins, polyazoles, polyimides and mixtures thereof. In some other embodiments, suitable fibrid materials are polyacrylonitrile, polycaproamide, polyvinyl alcohol, polycondensation products of dicarboxylic acids with dihydroxyalcohols (polyester) and the like. Suitable polyesters include saturated polyesters such as poly(ethylene terephthalate), polycarbonate and polybutyrate. Fibrids from aramid materials will provide better thermal stability of the paper in comparison with other mentioned materials. The preferred polymer for the fibrids are aramids, specifically, meta-aramids, and, more specifically, poly(m phenylene isophthalamide).

The desired relative amounts of floc and binder in the nonwoven sheet composition is dependent on the type of floc and binder used, the process used to manufacture the nonwoven sheet, and the desired isotropic or substantially isotropic strain to failure properties of the nonwoven sheet. For example when meta-aramid fibrids and meta-aramid fibers made into a paper on a Fourdrinier paper machine, in some embodiments the fiber can be present in the nonwoven sheet in amount of 40 to 60 percent by weight, the fibrids also being present in an amount of 60 to 40 percent by weight. If meta-aramid fibrids and para-aramid fibers made into a paper on an inclined wire paper machine, in some embodiments the fiber can be present in the nonwoven sheet in an amount of 70 to 90 percent by weight, the fibrids being present in an amount of 10 to 30 percent by weight.

Other polymer binders such as water-soluble resins, or combinations of different types of polymer binders can also be used. Resin used as a binder can be in the form of a water-soluble or dispersible polymer added directly to the paper making dispersion or in the form of thermoplastic binder fibers of the resin material intermingled with the aramid fibers to be activated as a binder by heat applied during drying or following additional compression and/or heat treatment. The preferred materials for the water-soluble or dispersible binder polymer are water soluble or water-dispersible thermosetting resins such as polyamide resins, epoxy resins, phenolic resins, polyureas, polyurethanes, melamine formaldehyde resins, polyesters and alkyd resins, generally. Particularly useful are water-soluble polyamide resins, such as cationic wet-strength resins such as those available under the tradename KYMENE® 557LX. Water solutions and dispersion of non-cured polymers can be used as well (poly (vinyl alcohol), poly(vinyl acetate), etc.). If a water-soluble binder is used, the fiber can be present in the nonwoven sheet in some embodiments in an amount of 88 to 97 percent by weight, the binder being present in an amount of from about 3 to 12 percent by weight.

Other polymer binders can be used, such as thermoplastic binder floc that can be fused during drying or calendering operations. In some embodiments, the thermoplastic binder floc can be made from such polymers as poly(vinyl alcohol), polypropylene, polyester and the like and should have a length and diameter similar to those of the floc described above. Additional ingredients such as fillers for the adjustment of paper conductivity and other properties, pigments, antioxidants, etc in powder or fibrous form can be added to the paper composition if desired.

In some embodiments, the nonwoven sheet is made on conventional papermaking equipment. The equipment can be of any scale, from laboratory screens to commercial-sized machinery, including such commonly used machines as Fourdrinier or inclined wire paper machines. A typical process involves making a dispersion of fibrous material such as floc and binder, generally fibrids, in an aqueous liquid, draining the liquid from the dispersion to yield a wet composition and drying the wet paper composition. The dispersion can be made either by dispersing the fibers and then adding the fibrids or by dispersing the fibrids and then adding the fibers. The final dispersion can also be made by combining a dispersion of fibers with a dispersion of the fibrids; the dispersion can optionally include other additives such as inorganic materials. The concentration of fibers from the floc in the dispersion can range from 0.01 to 1.0 weight percent based on the total weight of the dispersion. The concentration of the binder in the dispersion can be up to 30 weight percent based on the total weight of solids. In a typical process, the aqueous liquid of the dispersion is generally water, but may include various other materials such as pH-adjusting materials, forming aids, surfactants, defoamers and the like. The aqueous liquid is usually drained from the dispersion by conducting the dispersion onto a screen or other perforated support, retaining the dispersed solids and then passing the liquid to yield a wet paper composition. The wet composition, once formed on the support, is usually further dewatered by vacuum or other pressure forces and further dried by evaporating the remaining liquid.

In one preferred embodiment, the fiber and the binder can be slurried together to form a mix that is converted to paper on a wire screen or belt. Reference is made to U.S. Pat. Nos. 4,698,267 and 4,729,921 to Tokarsky; U.S. Pat. No. 5,026,456 to Hesler et al.; U.S. Pat. No. 5,223,094 and U.S. Pat. No. 5,314,742 to Kirayoglu et al for illustrative processes for forming papers from aramid fibers and aramid fibrids.

Once the nonwoven sheet or paper is formed, if desired it can be densified or consolidated further by calendering the sheet or paper between heated rolls, depending on the final desired density and thickness. Also some adjustments of final paper density can be made during forming the paper by regulating the amount of vacuum exerted on the paper slurry while on the forming table and/or adjusting the nip pressure in wet presses. In some embodiments, calendered paper is preferred, with the calendering taking place using roll temperatures and/or pressures as needed to provide the required paper density and thickness. An optional final step in the paper manufacturing can include a surface treatment of the paper in a corona or plasma atmosphere to further improve surface properties of the nonwoven sheet.

Each of the sheet layers 14 has a thickness of at least 0.013 mm (0.5 mil), with the thickness of each of the nonwoven sheet layers being typically from 0.013-0.450 mm (0.5-18 mil), more preferably 0.025-0.300 mm (1-12 mil) and most preferably 0.025-0.150 mm (1-6 mil). Preferably, each of the sheet layers 14 have an average acoustic velocity of at least 1200 m/sec, more preferably at least 1500 m/sec and even more preferably at least 2000 m/sec.

Each of the sheet layers 14 has a ratio of maximum strain to failure value to minimum strain to failure value of 1 to 5, preferably 1 to 3, and most preferably 1 to 1 when tested in accordance with ASTM method D882. In other words, the sheet layers 14 are isotropic or substantially isotropic with regards to its strain to failure properties.

The sheet layers 14 comprise 0.5 to 30 wt %, more preferably 3 to 28 wt %, and even more preferably 5 to 26 wt %, of the total weight of the article 10, 26, 40, 48.

Examples of suitable nonwoven sheets include para-aramid and/or meta-aramid floc and a binder, preferably a meta-aramid binder. Papers made with Kevlar® aramid fiber and Nomex® aramid fiber are commercially available from E. I. du Pont de Nemours and Company, Wilmington, Del. Kevlar® N636 and Nomex® T412 grades are preferred.

Core Section

The woven fabric layers 12 and the sheet layers 14 stacked together comprise the first core section 16. The first core section 16 preferably includes 3 to 60 of the woven fabric layers 12 and 3 to 60 of the sheet layers 14. More preferably, it includes 8 to 50 of the woven fabric layers 12 and 5 to 50 of the sheet layers 14. Even more preferably, it includes 10 to 45 of the woven fabric layers 12 and 8 to 45 of the sheet layers 14.

Figure 2:
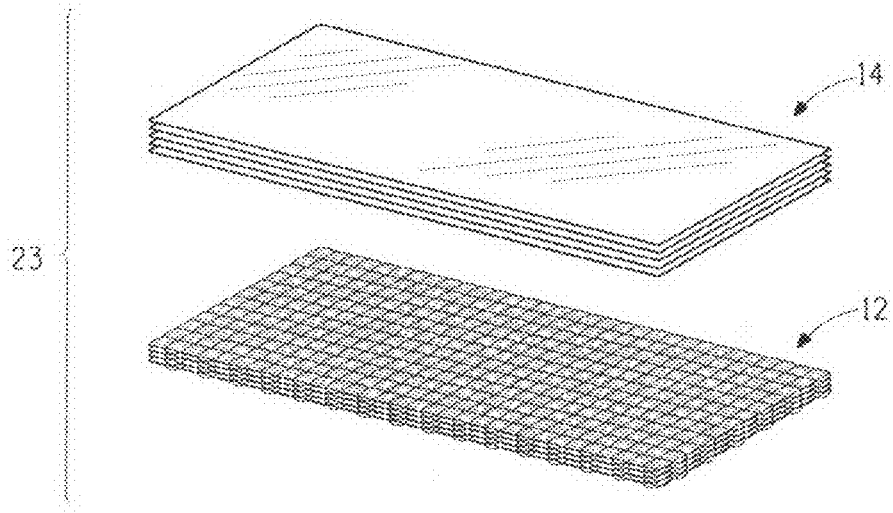
FIG. 2 is an exploded perspective view of a repeating section having, in order, a plurality of fabric layers and a plurality of nonwoven sheet layers in accordance with the present invention.

Preferably, the core section 16 includes at least two repeating units 22 of, in order, at least one of the woven fabric layers 12 then at least one of the sheet layers 14. The repeating unit 22 may optionally comprise, in order, only one of the woven fabric layers 12 and at least two of the sheet layers 14. The repeating unit 22 may alternatively or in addition include, in order, at least two of the woven fabric layers 12 and only one of the sheet layers 14. FIG. 2 shows an embodiment of the repeating unit 23 with a plurality of the woven fabric layers stacked adjacent to a plurality of the sheet layers. Preferably, there are 3 to 50, more preferably 5 to 40, even more preferably 8 to 35, of the repeating units 22, 23.

Figure 3:
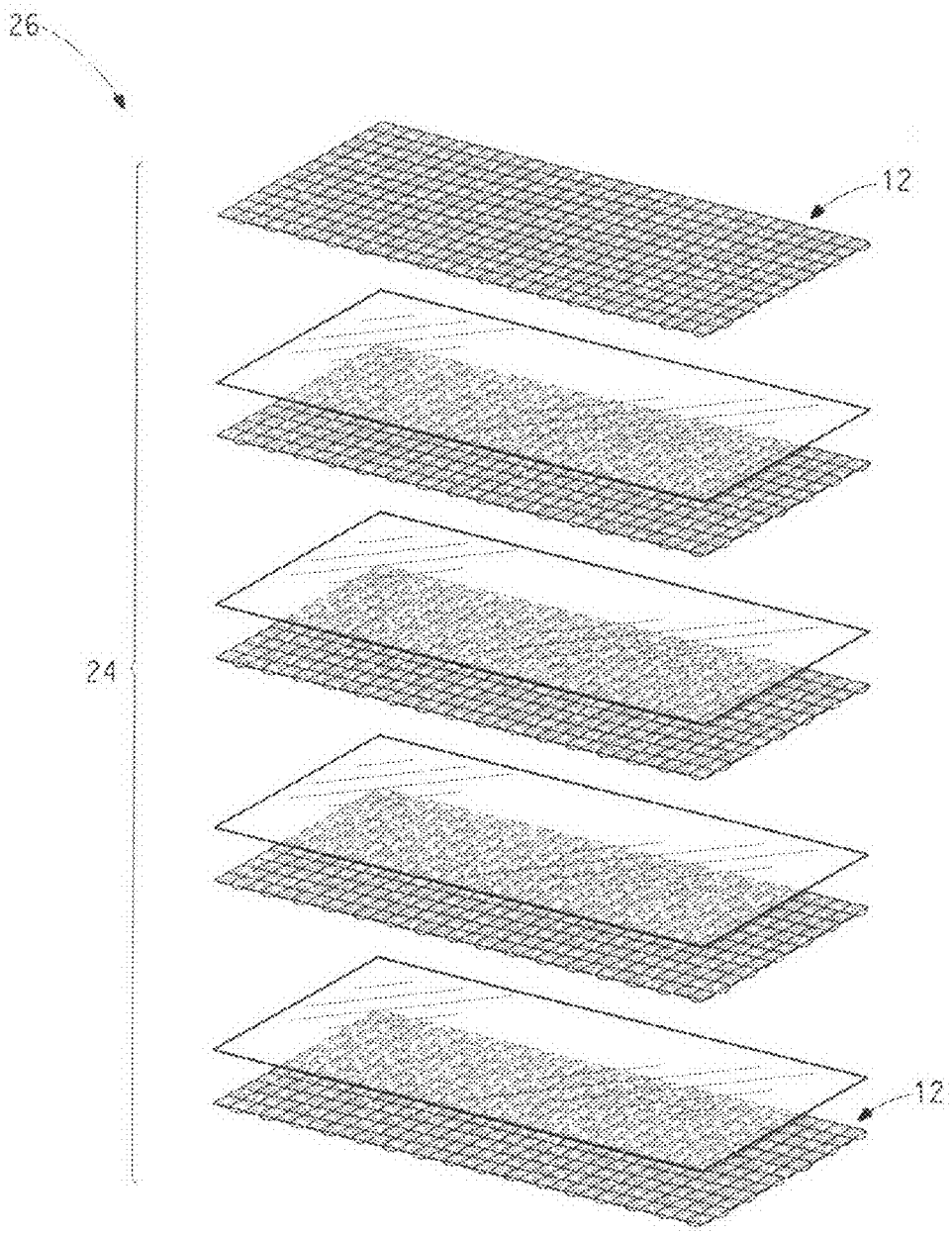
FIG. 3 is an exploded perspective view of a second embodiment of a ballistic penetration resistant article with a woven fabric layer on each end in accordance with the present invention.

As shown in FIG. 1, the core section 16 can have a woven fabric layer 12 at one end and a sheet layer at the other distal end. Alternatively, as shown in FIG. 3, the core section 24 can have a woven fabric layer 12 at each end.

Figure 4:
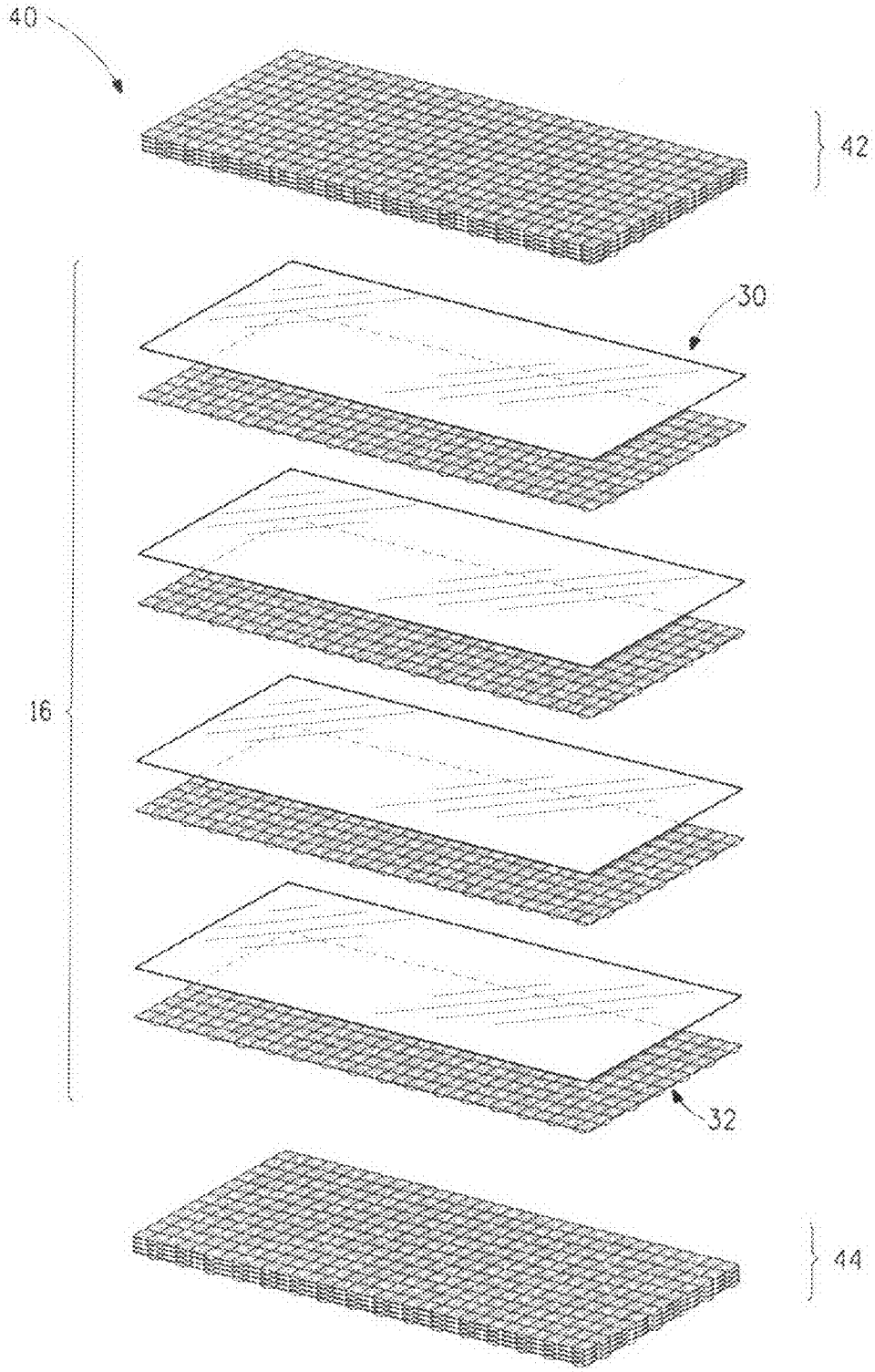
FIG. 4 is an exploded perspective view of a third embodiment of a ballistic penetration resistant article comprising, in order, a first strike section, a repeating section, and a body facing section in accordance with the present invention.

Referring again to FIG. 1, the core section 16 has a first strike end surface 30 and a second body facing end surface 32. Referring to FIG. 4, the article 40 can optionally further comprise a first strike section 42 and a body facing section 44. The first strike section 42 can comprise a plurality of the woven fabric layers 12 stacked together and stacked on the first strike end surface 30 of the core section 16. The body facing section 44 can comprise a plurality of the woven fabric layers 12 stacked together and stacked on the body facing surface 32 of the core section 16.

The first strike section 42 can have 2 to 30 woven fabric layers stacked together and the body facing section 44 can have 2 to 30 woven fabric layers stacked together. If desired the woven fabric layers 12 of the first strike section 42 and the body facing section 44 can be the same or different.

Figure 5:
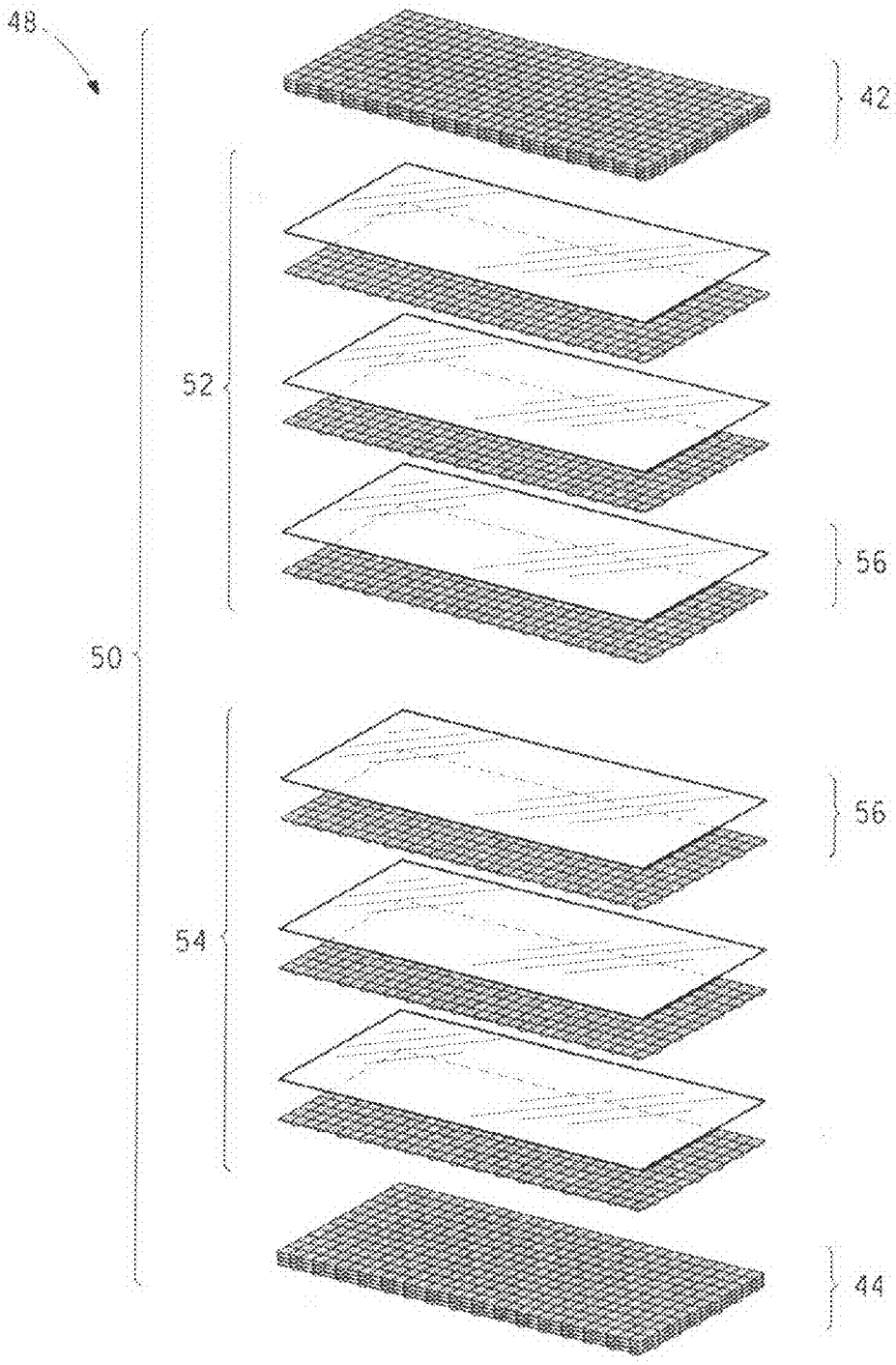
FIG. 5 is a an exploded perspective view of a fourth embodiment of a ballistic penetration article comprising, in order, a first strike section, a first repeating section, a second repeating section, and a body section in accordance with the present invention.

Referring to FIG. 5, the core section 50 can comprises a plurality of core subsections 52, 54, each core subsection 52, 54 with a repeating unit 56.

Body Armor Article

Preferably, the article 10, 26, 40, 48 has a backface deformation of less than or equal to 44 mm at a projectile velocity ($V_o$) of 1430 ft/sec plus or minus (+/−) 30 ft/sec (436 m/sec +/−9 m/sec) in accordance with NIJ Standard—0101.04 "Ballistic Resistance of Personal Body Armor", issued in September 2000.

Figure 6:
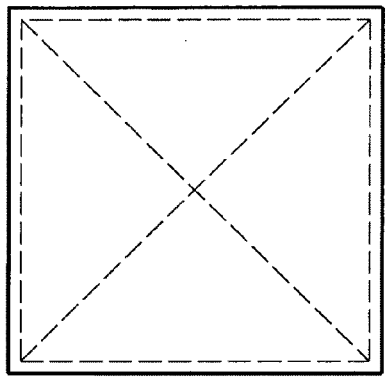
FIG. 6 shows a first manner for attaching layers together.
Figure 7:
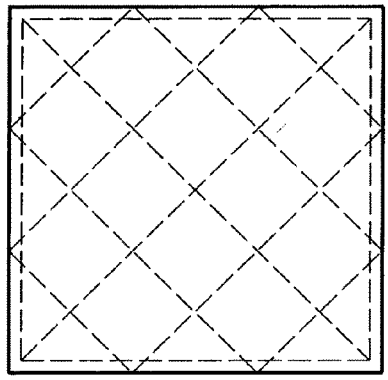
FIG. 7 shows a second manner for attaching layers together.
Figure 8:
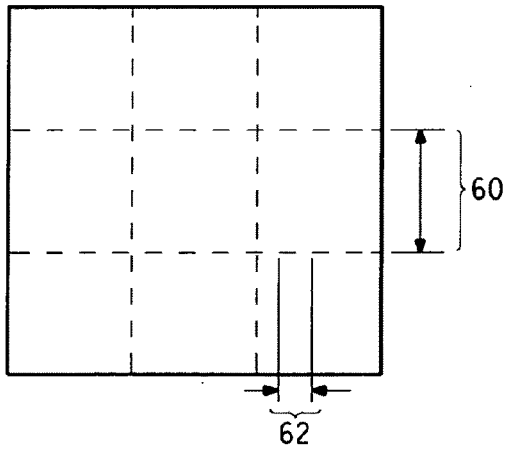
FIG. 8 shows a third manner for attaching layers together.

Preferably, the woven fabric layers 12 and the sheet layers 14 are only attached together at 10% or less of their surface areas allowing all or most of the remainder of the layers to move laterally and/or separate with respect to adjacent layers. The layers can be attached by stitches or adhesive or melt bonding, at edges and/or in the pattern of a cross (X), both as shown in FIG. 6, or in a pattern of squares typically done on a quilt, as shown in FIGS. 7 and 8. The stitch pattern illustrated in FIG. 7 is referred to as a quilted stitch pattern with additional edge stitching. More preferably, they are attached by less than 5%, and even more preferably less than 3%, of the surface area of the layers. Further, referring to FIG. 8, when the stitch pattern is in squares, preferably, the stitch spacing 60 is from about 48 to about 54 mm and more preferably from about 50 to about 52 mm. "Stitch spacing" is defined as the distance 60 between adjacent parallel stitches in a stitch pattern of squares on the face of layers. Also preferably the stitch length 62 is from about 3 to about 7 mm and more preferably from about 4 to about 6 mm. "Stitch length" is defined as the shortest repeating length 62 of stitching yarn that transverses the face of the layer.

Preferably, the article 10, 26, 40, 48 does not include any unidirectional tape or unidirectional assembly. By "unidirectional tape" is meant an array of generally parallel high tenacity multifilament yarns generally in a plane in a matrix resin. By "unidirectional assembly" is meant a plurality of the unidirectional tapes stacked with adjacent tapes with their yarns at angles inclined with respect to adjacent tapes. Typically the yarns in the tapes are at right angles with respect to yarns in adjacent tapes. Unidirectional tapes and assemblies are disclosed in U.S. Pat. No. 5,160,776 to Li et al.

Preferably, the woven fabric layers 12 and the sheet layers 14, stacked together, have an areal density of 2.5 to 5.7 kg/m$^2$, and more preferably 3.0 to 5.2 kg/m$^2$.

INDUSTRIAL APPLICABILITY

The articles include protective apparel or body armor that protect body parts, such as vests, jackets, etc. from projectiles. The term "projectile" is used herein to mean a bullet or other object or fragment thereof, such as, fired from a gun.

Test Methods

The following test methods were used in the following Examples.

Temperature: All temperatures are measured in degrees Celsius (° C.).

Linear Density: The linear density of a yarn or fiber is determined by weighing a known length of the yarn or fiber based on the procedures described in ASTM D1907-97 and D885-98. Decitex or "dtex" is defined as the weight, in grams, of 10,000 meters of the yarn or fiber. Denier (d) is 9/10 times the decitex (dtex).

Tensile Properties: The yarns to be tested were conditioned and then tensile tested based on the procedures described in ASTM D885-98. Tenacity (breaking tenacity), modulus of elasticity and elongation to break are determined by breaking test yarns on an Instron tester.

Areal Density: The areal density of the fabric layer is determined by measuring the weight of each single layer of selected size, e.g., 10 cm×10 cm. The areal density of a composite structure is determined by the sum of the areal densities of the individual layers.

Average Acoustic Velocity: The acoustic velocity is the speed at which the tensile stress wave is transmitted through a material and was measured according to ASTM E494 in various directions and an average acoustic velocity was calculated. It is reported in m/sec. The reported average acoustic velocity is the average value of acoustic velocities that are measured traveling radially from a point of impact in the sheet layer set at (0,0) at 0°, 45°, 90°, 135°, 180°, −45°, −90°, −135° with respect to the positive x axis, with the machine or roll direction positioned along the x axis and the cross or transverse direction positioned along the y axis.

Ballistic Penetration and Backface Deformation Performance: Ballistic tests of the multi-layer panels are conducted in accordance with NIJ Standard—0101.04 "Ballistic Resistance of Personal Body Armor", issued in September 2000. The reported V50 values are average values for the number of shots fired for each example. Either two or four shots were fired per example.

EXAMPLES

The following examples are given to illustrate the invention and should not be interpreted as limiting it in any way. All parts and percentages are by weight unless otherwise indicated. Examples prepared according to the process or processes of the current invention are indicated by numerical values. Control or Comparative Examples are indicated by letters. Data and test results relating to the Comparative and Inventive Examples are shown in Tables 1 and 2.

Description of Layers

Layers of the following high tenacity fiber fabrics and nonwoven sheet structures were prepared and made into various composite assemblies for ballistic test as follows.

Fabric layer "F1" was a plain weave woven fabric of 840 denier (930 dtex) poly(p-pheynlene terephthalamide) (or PA) yarn available from E. I. du Pont de Nemours and Company under the trade name of Kevlar® para-aramid brand 129 yarn and was woven at 26×26 ends per inch (10.2×10.2 ends per centimeter).

Fabric layer "F2" was a plain weave woven fabric of 600 denier (660 dtex) poly(p-pheynlene terephthalamide) (or PA) yarn available from E. I. du Pont de Nemours and Company under the trade name of Kevlar® para-aramid brand X300 yarn and was woven at 34×34 ends per inch (13.4×13.4 ends per centimeter).

Sheet layer "S1" was a poly(paraphenyleneterethalamide) pulp sheet or sheet structure made according to U.S. Pat. No. 6,030,683 using Kevlar®) 1F-361 pulp available from E. I. du Pont de Nemours and Company with an average acoustic velocity of 990 m/s, a thickness of 15 mil (0.375 mm), and a ratio of maximum to minimum elongation at break for any two given directions of 1.45.

Sheet layer "S2" was a poly(paraphenyleneterethalamide) paper sheet or sheet structure available from E. I. du Pont de Nemours and Company under the trade name of Kevlar® N636 with an average acoustic velocity of 3550 m/s, a thickness of 1.4 mil (0.035 mm), and a ratio of maximum to minimum elongation at break for any two given directions of 1.10.

Sheet layer "S3" was an poly(metaphenylene isophthalamide) paper sheet or sheet structure available from E. I. du Pont de Nemours and Company under the trade name of Nomex®T412 with an average acoustic velocity of 2180 m/s, a thickness of 1.4 mil (0.035 mm), and a ratio of maximum to minimum elongation at break for any two given directions of 2.41.

Sheet layer "S4" was a poly(paraphenyleneterethalamide) nonwoven sheet or sheet structure Grade 8000056 available from the Advanced Fiber Nonwovens Division of the Hollingsworth & Vose Company, Hawkinsville, Ga. with an average acoustic velocity of 2445 m/s, a thickness of 4.2 mil (0.11 mm), and a ratio of maximum to minimum elongation at break for any two given directions of 1.23. The binder was uncrimped polyester present at a level of 12%.

Example A

Twenty four layers of fabric layers F1 of about 15"×15" were stitched together by stitches forming a quilted stitch pattern having a stitch spacing of about 2 inches (5 cm) and a stitch length of about 0.2 inch (0.5 cm) into an article with an areal density of about 4.73 kg/m$^2$. Ballistic tests were conducted using 0.44 magnum bullets based on the test protocol for NIJ Level IIIA as described in NIJ Standard—0101.04 entitled "Ballistic Resistance of Personal Body Armor". Results of the ballistic tests for eight shots, including both V50 and backface deformation, as shown in the Table 2, exhibit backface deformations as high as 61 mm but good ballistic V50.

Example B

In this example, a stacked article was made comprising, in order, (a) a first strike section of 5 fabric layers F1, (b) a core section comprising a repeating unit of a fabric layer F1 then a sheet layer S1, the unit repeated 8 times, and (c) a body facing section comprising 6 fabric layers F1. This article construction is referenced herein as 5F1+8(F1+S1)+6F1. This stacked article was made of about 15 inches by 15 inches (38 cm by 38 cm) of each layer held together with stitches forming a quilted stitch pattern having a stitch spacing of about 2 inches (5 cm) and a stitch length of about 0.2 inch (0.5 cm). The areal density of the article was about 4.91 kg/m$^2$. Ballistic tests were conducted using 0.44 magnum bullets based on the test protocol for NIJ Level IIIA as described in NIJ Standard—0101.04 entitled "Ballistic Resistance of Personal Body Armor". Results of the ballistic tests for two shots, including both V50 and backface deformation, as shown in the Table 2, showed a backface deformation value of 60 mm while the second shot was a complete failure with no deformation value being recorded. The V50 performance was poor.

Example D

In this example, a stacked article was made comprising, in order, (a) a first strike section of 9 fabric layers F1, (b) a core section comprising a repeating unit of a fabric layer F1 then a sheet layer S1, the unit repeated 4 times, and (c) a body facing section comprising 9 fabric layers F1. This article construction is referenced herein as 9F1+4(F1+S1)+9F1. This stacked article was made of about 15 inches by 15 inches (38 cm by 38 cm) of each layer held together with stitches forming a quilted stitch pattern having a stitch spacing of about 2 inches (5 cm) and a stitch length of about 0.2 inch (0.5 cm). The areal density of the article was about 4.98 kg/m$^2$. Ballistic tests were conducted using 0.44 magnum bullets based on the test protocol for NIJ Level IIIA as described in NIJ Standard—0101.04 entitled "Ballistic Resistance of Personal Body Armor". Results of the ballistic tests for two shots, including both V50 and backface deformation, as shown in the Table 2, showed a backface deformation value of 53 mm while the second shot was a complete failure with no deformation value being recorded. The V50 performance was poor.

Example E

In this example, a stacked article was made comprising, in order, (a) a first strike section of 1 fabric layer F1 and a core section comprising a repeating unit of a sheet layer S4 then a fabric layer F1, the unit repeated 22 times. This article construction is referenced herein as 1F1+22(S4+F1). This stacked article was made of about 15 inches by 15 inches (38 cm by 38 cm) of each layer held together with stitches forming a quilted stitch pattern having a stitch spacing of about 2 inches (5 cm) and a stitch length of about 0.2 inch (0.5 cm). The areal density of the article was about 4.93 kg/m$^2$. Ballistic tests were conducted using 0.44 magnum bullets based on the test protocol for NIJ Level IIIA as described in NIJ Standard—0101.04 entitled "Ballistic Resistance of Personal Body Armor". Results of the ballistic tests for two shots, including both V50 and backface deformation, as shown in the Table 2, showed a backface deformation values of 46 and 49 mm. The V50 performance was good.

Example F

In this example, a stacked article was made comprising, in order, (a) a first strike section of 8 fabric layers F1 (b) 19 sheet layers S4 (c) 6 fabric layers F1, (d) 19 sheet layers S5 and (e) 8 fabric layers F1. This article construction is referenced herein as 8F1+19S4+6F1+19S4+8F1. This stacked article was made of about 15 inches by 15 inches (38 cm by 38 cm) of each layer held together with stitches forming a quilted stitch pattern having a stitch spacing of about 2 inches (5 cm) and a stitch length of about 0.2 inch (0.5 cm). The areal density of the article was about 5.08 kg/m$^2$. Ballistic tests were conducted using 0.44 magnum bullets based on the test protocol for NIJ Level IIIA as described in NIJ Standard—0101.04 entitled "Ballistic Resistance of Personal Body Armor". Results of the ballistic tests for two shots, including both V50 and backface deformation, as shown in the Table 2, showed a backface deformation values of 45 and 46 mm. The V50 performance was acceptable.

Example 1

In this example, a stacked article was made comprising, in order, (a) a first strike section having 1 fabric layer F1, (b) a core section comprising a repeating unit of a fabric layer F1 then a Sheet layer S2, the unit repeated 21 times. This article construction is referenced herein as 1F1+21(F1+S2). This stacked article was about 15 inches by 15 inches (38 cm by 38 cm) of each layer held together with stitches forming a quilted stitch pattern having a stitch spacing of about 2 inches (5 cm) and a stitch length of about 0.2 inch (0.5 cm). The areal density of the article was about 5.03 kg/m$^2$. Ballistic tests were conducted using 0.44 magnum bullets based on the test protocol for NIJ Level IIIA as described in NIJ Standard—0101.04 entitled "Ballistic Resistance of Personal Body Armor". Results of the ballistic tests for four shots, including both V50 and backface deformation, as shown in the Table 2, exhibit backface deformation values between 34 and 41 mm and good ballistic V50.

Example 2

In this example, a stacked article was made comprising, in order, (a) a first strike section having 1 fabric layer F1, (b) a core section comprising a repeating unit of a fabric layer F1 then a sheet layer S3, the unit repeated 21 times. This article construction is referenced herein as 1F1+21(F1+S3). This stacked article was about 15 inches by 15 inches (38 cm by 38 cm) of each layer held together with stitches forming a quilted stitch pattern having a stitch spacing of about 2 inches (5 cm) and a pitch length of about 0.2 inch (0.5 cm). The areal density of the article was about 4.98 kg/m$^2$. Ballistic tests were conducted using 0.44 magnum bullets based on the test protocol for NIJ Level III A as described in NIJ Standard—0101.04 entitled "Ballistic Resistance of Personal Body Armor". Results of the ballistic tests for two shots, including both V50 and backface deformation, as shown in the Table I, exhibit backface deformation values of 41 mm and good ballistic V50.

Examples 1 and 2 show that structures according to the present invention having an areal density similar to the areal density of comparison Example A have substantially less backface deformation than the comparison and the penetration margin of safety (V50 minus the Vo) substantially higher than traditionally required in the industry (i.e., 28 m/sec). Comparative Examples B and D are based on the disclosure of U.S. Pat. No. 6,030,683 and show that the pulp sheet of this patent does not provide acceptable ballistic performance against 0.44 magnum bullets. Example B had twice as many pulp sheets as Example D. Examples 1 and 2, on the other hand, show that even with a sheet thickness only 2% of that of Example B, satisfactory ballistic performance is achieved.

Example 4

In this example, a stacked article was made comprising, in order, (a) a first strike section of 1 fabric layer F1 and a core section comprising a repeating unit of 2 sheet layers S4 then a fabric layer F1, the unit repeated 21 times. This article construction is referenced herein as 1F1+21(2S4+F1). This stacked article was made of about 15 inches by 15 inches (38 cm by 38 cm) of each layer held together with stitches forming a quilted stitch pattern having a stitch spacing of about 2 inches (5 cm) and a stitch length of about 0.2 inch (0.5 cm). The areal density of the article was about 4.94 kg/m$^2$. Ballistic tests were conducted using 0.44 magnum bullets based on the test protocol for NIJ Level IIIA as described in NIJ Standard—0101.04 entitled "Ballistic Resistance of Personal Body Armor". Results of the ballistic tests for two shots, including both V50 and backface deformation, as shown in the Table 2, showed a backface deformation values of 42 and 43 mm. The V50 performance was good.

Example 5

In this example, a stacked article was made comprising, in order, (a) a first strike section of 1 fabric layer F1 and a core section comprising a repeating unit of 3 sheet layers S4 then a fabric layer F1, the unit repeated 20 times. This article construction is referenced herein as 1F1+20(3S4+F1). This stacked article was made of about 15 inches by 15 inches (38 cm by 38 cm) of each layer held together with stitches forming a quilted stitch pattern having a stitch spacing of about 2 inches (5 cm) and a stitch length of about 0.2 inch (0.5 cm). The areal density of the article was about 4.94 kg/m$^2$. Ballistic tests were conducted using 0.44 magnum bullets based on the test protocol for NIJ Level IIIA as described in NIJ Standard—0101.04 entitled "Ballistic Resistance of Personal Body Armor". Results of the ballistic tests for two shots, including both V50 and backface deformation, as shown in the Table 2, showed a backface deformation values of 38 and 40 mm. The V50 performance was good.

Example 4

In this example, a stacked article was made comprising, in order, (a) a first strike section of 1 fabric layer F1 and a core section comprising a repeating unit of 2 sheet layers S4 then a fabric layer F1, the unit repeated 21 times. This article construction is referenced herein as 1F1+21(2S4+F1). This stacked article was made of about 15 inches by 15 inches (38 cm by 38 cm) of each layer held together with stitches forming a quilted stitch pattern having a stitch spacing of about 2 inches (5 cm) and a stitch length of about 0.2 inch (0.5 cm). The areal density of the article was about 4.94 kg/m$^2$. Ballistic tests were conducted using 0.44 magnum bullets based on the test protocol for NIJ Level IIIA as described in NIJ Standard—0101.04 entitled "Ballistic Resistance of Personal Body Armor". Results of the ballistic tests for two shots, including both V50 and backface deformation, as shown in the Table 2, showed a backface deformation values of 42 and 43 mm. The V50 performance was good.

Example 5

In this example, a stacked article was made comprising, in order, (a) a first strike section of 1 fabric layer F1 and a core section comprising a repeating unit of 3 sheet layers S4 then a fabric layer F1, the unit repeated 20 times. This article construction is referenced herein as 1F1+20(3S4+F1). This stacked article was made of about 15 inches by 15 inches (38 cm by 38 cm) of each layer held together with stitches forming a quilted stitch pattern having a stitch spacing of about 2 inches (5 cm) and a stitch length of about 0.2 inch (0.5 cm). The areal density of the article was about 4.94 kg m$^2$. Ballistic tests were conducted using 0.44 magnum bullets based on the test protocol for NIJ Level IIIA as described in NIJ Standard—0101.04 entitled "Ballistic Resistance of Personal Body Armor". Results of the ballistic tests for two shots, including both V50 and backface deformation, as shown in the Table 2, showed a backface deformation values of 38 and 40 mm. The V50 performance was good.

Comparing Examples 4 and 5 with Examples E and F shows that there is a minimum number of nonwoven sheet layers required to provide adequate back face deformation resistance. The 22 sheet layers in Example E was insufficient, the 38 and 42 layers in Examples F and 4 respectively was barely adequate while the 60 layers of Example 5 provided good performance. The number of sheet layers required will vary for different sheet materials.

Example C

Twenty eight layers of fabric layer F2 of about 15"∴15" were stitched together forming a quilted stitch pattern having a stitch spacing of about 2 inches (5 cm) and a stitch length of about 0.2 inch (0.5 cm) into an article with an areal density of about 5.08 kg/m$^2$. Ballistic tests were conducted using 9 mm bullets and back face deformation measured at a velocity of 1430 ft/sec plus or minus (+/−) 30 ft/sec (436 m/sec−/+9 m/sec). Results of the ballistic tests of two shots, including both V50 and backface deformation, as shown in the Table I, exhibited good backface deformation at 31 mm as well as satisfactory V50.

Example 3

In this example, a stacked article was made comprising, in order, (a) a first strike section of 7 fabric layers F2, (b) a core section comprising a repeating unit of 1 fabric layer F2 and 1 sheet layer S2, the unit repeated 11 times, and (c) a body facing section of 7 fabric layers of F2. This article construction is referenced herein as 7F2+11(F2+S2)+7F2. This article was made of about 15 inches by 15 inches (38 cm by 38 cm) of each layer stitched together forming a quilted stitch pattern having a stitch spacing of about 2 inches (5 cm) and a pitch length of about 0.2 inch (0.5 cm). The areal density of the article was about 5.12 kg/m$^2$. Ballistic tests were conducted using 9 mm bullets and back face deformation measured at a velocity of 1430 ft/sec plus or minus (+/−) 30 ft/sec (436 m/sec+/−9 m/sec). Results of the ballistic tests of two shots, including both V50 and backface deformation, as shown in the Table I, exhibit extremely good backface deformation and excellent ballistic V50.

Comparison of Example 3 with Example C shows that, although Example C itself has a good back face deformation, improvements in excess of 20% were obtained using an assembly of this invention.

TABLE 1

| Example Number | Article Construction | Fiber Material | Filaments per Yarn | Fiber Linear Density (dtex per filament) | Yarn Linear Density (dtex) | Yarn Tenacy (g/dtex) | Yarn Modulus (g/dtex) | Yarn Elongation to Break (%) | Woven Fabric Ends in Warp and Fill Directions (cm × cm) | Number of Fabric Layers |
|---|---|---|---|---|---|---|---|---|---|---|
| A | 24 layers of PA 930dtex F1 | Para-aramid | 560 | 1.66 | 930 | 24.3 | 676 | 3.4 | 10.2 × 10.2 | 24 |
| B | 5F1 + 8(F1 + S1) + 6F1, where S1 is pulp sheet, F1 is 930 dtex fabric | Para-Aramid | 560 | 1.66 | 930 | 24.3 | 676 | 3.4 | 10.2 × 10.2 | 19 |
| D | 9F1 + 4(F1 + S1) + 9F1, where S1 is pulp sheet, F1 is 930 dtex fabric | Para-Aramid | 560 | 1.66 | 930 | 24.3 | 676 | 3.4 | 10.2 × 10.2 | 22 |
| E | 1F1 + 22(S4 + F1), where S4 is grade 8000056 aramid nonwoven mat, F1 is 930 dtex fabric | Para-Aramid | 560 | 1.66 | 930 | 24.3 | 676 | 3.4 | 10.2 × 10.2 | 23 |
| F | 6F1 + 19S4 + 6F1 + 19S4 + 8F1, where S4 is grade 8000056 aramid nonwoven mat, F1 is 930 dtex fabric | Para-Aramid | 560 | 1.66 | 930 | 24.3 | 676 | 3.4 | 10.2 × 10.2 | 20 |

TABLE 1-continued

| Example Number | Article Construction | Fiber Material | Filaments per Yarn | Fiber Linear Density (dtex per filament) | Yarn Linear Density (dtex) | Yarn Tenacy (g/dtex) | Yarn Modulus (g/dtex) | Yarn Elongation to Break (%) | Woven Fabric Ends in Warp and Fill Directions (cm × cm) | Number of Fabric Layers |
|---|---|---|---|---|---|---|---|---|---|---|
| 1 | 1F1 + 21(F1 + S2) where S2 is 1.4 mil N636 paper, F1 is 930 dtex fabric | Para-Aramid | 560 | 1.66 | 930 | 24.3 | 676 | 3.4 | 10.2 × 10.2 | 22 |
| 2 | 1F1 + 21(F1 + S3) where S3 is 1.4 mil T412 Nomex paper, F1 is 930 dtex fabric | Para-Aramid | 560 | 1.66 | 930 | 24.3 | 676 | 3.4 | 10.2 × 10.2 | 22 |
| 4 | 1F1 + 21(2S4 + F1), where S4 is grade 8000056 aramid nonwoven mat, F1 is 930 dtex fabric | Para-Aramid | 560 | 1.66 | 930 | 24.3 | 676 | 3.4 | 10.2 × 10.2 | 22 |
| 5 | 1F1 + 20(3S4 + F1), where S4 is grade 8000056 aramid nonwoven mat, F1 is 930 dtex fabric | Para-Aramid | 560 | 1.66 | 930 | 24.3 | 676 | 3.4 | 10.2 × 10.2 | 21 |
| C | 28 layers of PA 660 dtex F2 | Para-Aramid | 400 | 1.66 | 660 | 25.7 | 703 | 3.4 | 13.4 × 13.4 | 28 |
| 3 | 7F2 + 11(F2 + S2) + 7F2, where S2 is 1.4 mil N636 paper, F2 is 660 dtex fabric | Para-Aramid | 400 | 1.66 | 660 | 25.7 | 703 | 3.4 | 13.4 × 13.4 | 25 |

TABLE 2

| Example Number | Article Construction | Sheet Layer Material | Number of Sheet Layers | Single Sheet Layer Thickness (mm) | Accoustic Velocity Ratio of each Sheet Layer (m/s) | Number of Repeating Sections |
|---|---|---|---|---|---|---|
| A | 24 layers of PA 930 dtex F1 | NA | 0 | NA | NA | NA |
| B | 5F1 + 8(F1 + S1) + 6F1, where S1 is pulp sheet, F1 is 930 dtex fabric | Kevlar Pulp sheet | 8 | 0.375 | 990 | 8 |
| D | 9F1 + 4(F1 + S1) + 9F1, where S1 is pulp sheet, F1 is 930 dtex fabric | Kevlar Pulp sheet | 4 | 0.375 | 990 | 4 |
| E | 1F1 + 22(S4 + F1), where S4 is grade 8000056 aramid nonwoven mat, F1 is 930 dtex fabric | Para-aramid Nonwoven Mat | 22 | 0.110 | | 22 |
| F | 6F1 + 19S4 + 6F1 + 19S4 +8F1, where S4 is grade 8000056 aramid nonwoven mat, F1 is 930 dtex fabric | Para-aramid Nonwoven Mat | 38 | 0.110 | | NA |
| 1 | 1F1 + 21(F1 + S2) where S2 is 1.4 mil N636 paper, F1 is 930 dtex fabric | N636 Kevlar paper | 21 | 0.035 | 3550 | 21 |
| 2 | 1F1 + 21(F1 + S3) where S3 is 1.4 mil T412 Nomex paper, F1 is 930 dtex fabric | T412 Nomex Paper | 21 | 0.035 | 2180 | 21 |
| 4 | 1F1 + 21(2S4 + F1), where S4 is grade 8000056 aramid nonwoven mat, F1 is 930dtex fabric | Para-aramid Nonwoven Mat | 42 | 0.11 | | 21 |
| 5 | 1F1 + 20(3S4 + F1), where S4 is grade 8000056 aramid nonwoven mat, F1 is 930dtex fabric | Para-aramid Nonwoven Mat | 60 | 0.11 | | 20 |
| C | 28 layers of PA 660 dtex F2 | NA | 0 | NA | NA | NA |
| 3 | 7F2 + 11(F2 + S2) + 7F2, where S2 is 1.4 mil N636 paper, F2 is 660 dtex fabric | N636 Kevlar paper | 11 | 0.035 | 3550 | 11 |

TABLE 2-continued

| Example Number | Article Areal Density (kg/m$^2$) | Bullet Type | Backface Deformation (mm) at 436 +/− 10 m/sec | V50 (m/s) | Vo Penetration Margin of Safety (T or V50-436) (m/s) | Weight Percent of Sheet Layers (%) |
|---|---|---|---|---|---|---|
| A | 4.73 | .44 mag | 48; 61; 50; 51; 44; 55; 41; 49 | 477 | 41 | 0% |
| B | 4.91 | .44 Mag | Complete Failure; 60 | 443 | 7 | 21% |
| D | 4.98 | .44 Mag | Complete Failure; 53 | 456 | 20 | 9% |
| E | 4.93 | .44 Mag | 46; 49 | 498 | 62 | 4% |
| F | 5.08 | .44 Mag | 45; 46 | 500 | 64 | 8% |
| 1 | 5.03 | .44 Mag | 34; 41; 39; 41 | 506 | 70 | 11% |
| 2 | 4.98 | .44 Mag | 41; 41 | 497 | 61 | 10% |
| 4 | 4.94 | .44 Mag | 42; 43 | 503 | 67 | 8% |
| 5 | 4.94 | .44 Mag | 38; 40 | 497 | 61 | 12% |
| C | 5.08 | 9 mm | 31; 31 | | | 0% |
| 3 | 5.12 | 9 mm | 24; 24 | | | 11% |

What is claimed is:

1. A body armor article for resisting ballistic objects, comprising:

a plurality of woven fabric layers woven from yarns having a tenacity of at least 7.3 grams per dtex and a modulus of at least 100 grams per dtex;

a plurality of sheet layers comprising nonwoven random oriented fibrous sheets, each of the sheet layers comprising a uniform mixture of 3 to 60 weight percent polymeric binder and 40 to 97 weight percent non-fibrillated fibers, the non-fibrillated fibers having a yarn tenacity of at least 1.8 grams per dtex and a modulus of at least 75 grams per dtex, and wherein each of the sheet layers has a thickness of at least 0.013 mm;

the woven fabric layers and the sheet layers stacked together comprising a first core section which includes at least two repeating units of, in order, at least one of the woven fabric layers then at least one of the sheet layers; and the sheet layers comprising 0.5 to 30 wt % of the total weight of the article.

2. The article of claim 1, wherein the yarns have linear density of 50 to 4500 dtex, a tenacity of 10 to 65 g/dtex, a modulus of 150 to 2700 g/dtex, and an elongation to break of 1 to 8 percent.

3. The article of claim 1, wherein the yarns are made of filaments made from a polymer selected from the group consisting of polyamides, polyolefins, polyazoles, and mixtures thereof.

4. The article of claim 1, wherein the woven fabric sheets are not encased or coated with a matrix resin.

5. The article of claim 1, wherein each of the sheet layers have a thickness of no more than 0.450 mm (18 mils).

6. The article of claim 1, wherein the non-fibrillated fibers of the sheet layer are selected from the group consisting of polyamides including aromatic polyamides, polysulfonamides, polyphenylene sulfide, polyolefins, polyazoles, acrylonitrile, polyimides, glass, carbon, graphite and mixtures thereof.

7. The article of claim 1, wherein the polymeric binder of the sheet layer is a polymer fibrid.

8. The article of claim 1, wherein the polymeric binder is selected from from the group consisting of polyamides including aromatic polyamides, polysulfonamides, poly-phenylene sulfide, polyolefins, polyazoles, polyimides, acrylonitrile, polyvinyl alcohol, polycondensation products of dicarboxylic acids with dihydroxyalcohols and mixtures thereof.

9. The article of claim 1, wherein each of the sheet layers has an average acoustic velocity of at least 1200 m/sec.

10. The article of claim 1, wherein each of the sheet layers has a ratio of maximum strain to failure value to minimum strain to failure value of 1 to 5.

11. The article of claim 1, wherein the sheet layers are isotropic or substantially isotropic.

12. The article of claim 1, wherein the core section includes 3 to 60 of the woven fabric layers and 3 to 60 of the sheet layers.

13. The article of claim 1, wherein the core section includes at least two repeating units of, in order, at least one of the woven fabric layers then at least one of the sheet layers.

14. The article of claim 13, wherein the repeating unit comprises, in order, one of the woven fabric layers and at least two of the nonwoven sheet layers.

15. The article of claim 13, wherein the repeating unit comprises, in order, at least two of the woven fabric layers and one of the sheet layers.

16. The article of claim 1, wherein there are 3 to 50 of the repeating units.

17. The article of claim 1, wherein the core section has a first strike end surface and a body facing end surface; and the article further comprising a first strike section and an body facing section, the first strike section comprising a plurality of the woven fabric layers stacked together and stacked on the first strike end surface of the core section, and the body facing section comprising a plurality of the woven fabric layers stacked together and stacked on the body facing surface of the core section.

18. The article of claim 17, wherein the first strike section has 2 to 30 woven fabric layers stacked together and the body facing section has 2 to 30 woven fabric layers stacked together.

19. The article of claim 1, wherein the core section has a woven fabric end surface and a sheet end surface, further comprising at least one of the woven fabric layers stacked on the sheet end surface of the core section.

20. The article of claim 1, wherein the core section comprises a plurality of core subsections, each core subsection with a repeating unit.

21. The article of claim 1, wherein the article has a backface deformation of less than or equal to 44 mm at a projectile velocity ($V_o$) of 1430 ft/sec plus or minus (+/−) 30 ft/sec (436 m/sec+/−9 m/sec) in accordance with NIJ Standard—0101.04 "Ballistic Resistance of Personal Body Armor", issued in September 2000.

22. The article of claim 1, wherein the woven fabric layers and the sheet layers are only attached together at 10% or less of their surface areas allowing all or most of the remainder of the layers to move laterally and/or separate with respect to adjacent layers.

23. The article of claim 1, wherein the woven fabric layers and the sheet layers, stacked together, have an areal density of 2.5 to 5.7 kg/$m^2$.

* * * * *